United States Patent [19]

A'Costa

[11] 4,368,589

[45] Jan. 18, 1983

[54] HAND GUN AND KIT THEREFOR

[76] Inventor: Anthony A'Costa, 2216-7th Ave., Apt. C 301, Pueblo, Colo. 81003

[21] Appl. No.: 70,466

[22] Filed: Aug. 28, 1979

[51] Int. Cl.[3] ..... F41C 21/00

[52] U.S. Cl. ..... 42/77

[58] Field of Search ..... 42/77, 79, 76 R, 78

[56] References Cited

U.S. PATENT DOCUMENTS

| | | | |
|---|---|---|---|
| 37,193 | 12/1862 | Alsop | 42/79 |
| 797,345 | 8/1905 | Cokeroft | 42/79 |
| 804,483 | 11/1905 | Lincoln | 42/78 |
| 1,009,358 | 11/1911 | Wallmann | 42/77 |
| 1,281,195 | 10/1918 | Moor | 42/77 |
| 1,297,891 | 3/1919 | Moor | 42/77 |
| 1,455,661 | 5/1923 | Rhinehart | 42/79 |
| 2,466,400 | 4/1949 | Ennis | 42/79 |
| 2,503,491 | 4/1950 | Janz | 42/79 |
| 2,799,959 | 7/1957 | Osborn | 42/76 A |
| 2,849,923 | 9/1958 | Cotterman | 42/78 |
| 3,525,172 | 8/1970 | Marshall et al. | 42/76 R |
| 3,780,465 | 12/1973 | Polcha | 42/76 A |

*Primary Examiner*—Charles T. Jordan

*Attorney, Agent, or Firm*—Edwin E. Greigg

[57] ABSTRACT

A barrel extension for a weapon having a barrel internally threaded at its forward end together with various associated devices including a hand grip and a wrench which includes a tubular member having a smooth bore and an externally threaded end portion threadedly engageable with the threaded forward end portion of the weapon barrel with the barrel extension bore aligned with the barrel bore and including a hollow nightstick having an interior forming a storage cavity for the barrel extension, the nightstick having an internally threaded open end portion for threaded engagement with a threaded portion on a closure member to close the storage cavity in order to transport the barrel extension in a concealed manner.

5 Claims, 8 Drawing Figures

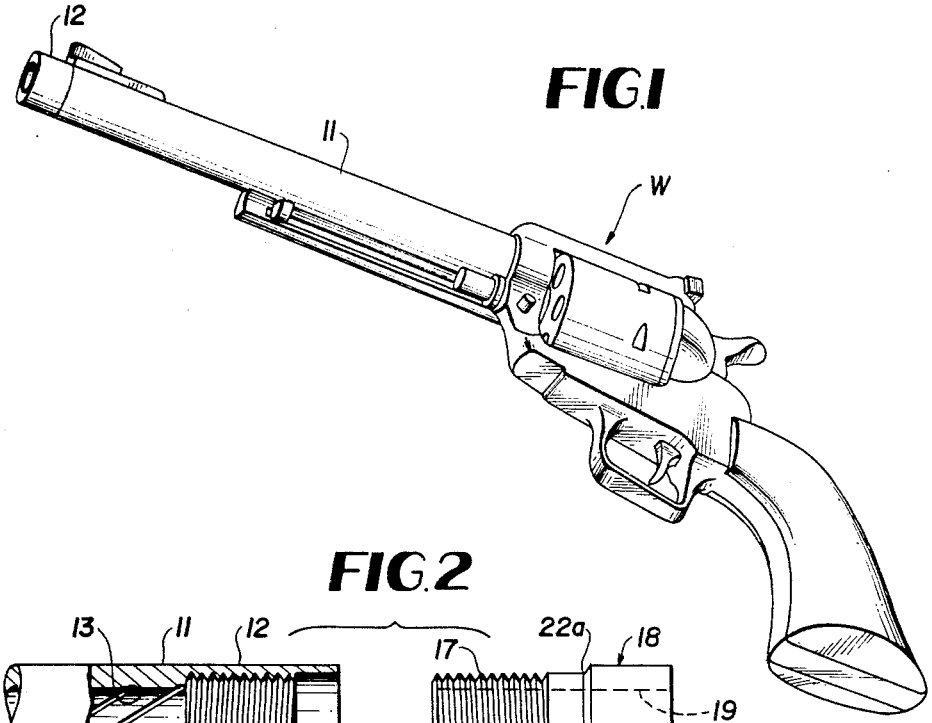
FIG.1
FIG.2
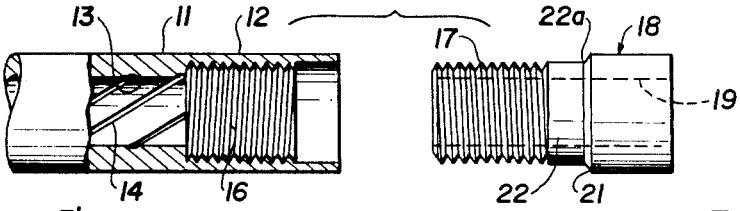
FIG.5
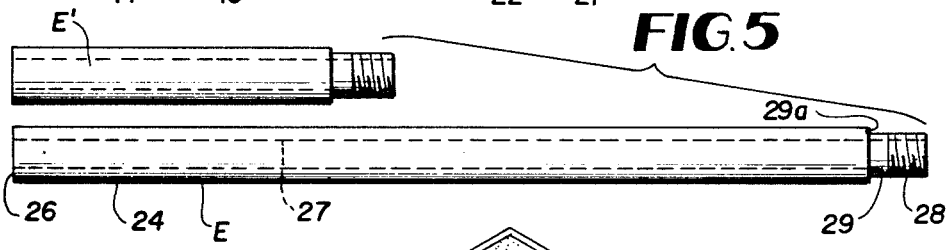
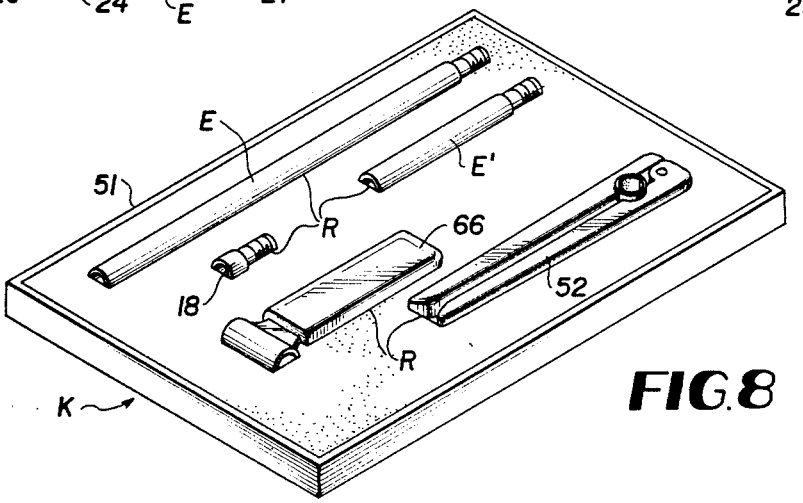
FIG.8

HAND GUN AND KIT THEREFOR

BACKGROUND OF INVENTION

It has long been known that the length of the barrel of a weapon such a pistol, rifle, or the like, substantially improves the accuracy of the weapon due to many factors such as increasing the muzzle velocity of the bullet, stablizing the bullet trajectory and etc. However, the additional length added to a weapon by an extension of the barrel generally makes the weapon unwieldy and difficult to handle during its use. In spite of such shortcomings, repeated efforts have been made to provide barrel extensions for weapons and various constructions have been proposed for detachably mounting such extensions on the barrel of the weapon. However, such proposed mounting arrangements for barrel extensions are characterized by certain limitations such as obtaining a proper attachment of the barrel extension to the weapon barrel so that no interference is encountered with the passage of the bullet through the extension and the difficulty in assembly and disassembly of the barrel extension particularly when the barrel extension is in a heated condition due to repeated firing of the weapon. Also, such present day mounting arrangements require a modification of the weapon barrel frequently producing improper operation of the weapon when the barrel extension is not in use.

Another problem area where barrel extensions are used particularly where barrel extensions of various lengths are provided is the problem of storage of the barrel extension when not in use. Obviously it is highly desirable that the barrel extension be readily available for use when desired and the length and weight of such a barrel extension seriously limits the portability of such extensions. While various carriers can be utilized for such barrel extensions, this is an added piece of equipment which must be carried by a person provided with a weapon. Furthermore, it is highly desirable that such a barrel extension be readily available for immediate use when desired and where the carrier is not properly designed, difficulties can be encountered in removal of the barrel extension from the carrier.

OBJECTS AND SUMMARY OF THE INVENTION

Accordingly, the primary object of this invention is to provide a new and novel barrel extension for attachment to the barrel of a weapon such as a pistol, rifle or the like.

Another object of the invention is to provide a new and novel barrel extension for a weapon for which adds considerably to the accuracy of the weapon and permits the full utilization of the explosive charges which expel the bullet from the weapon.

A further object of the invention is to provide a new and novel barrel extension for a weapon which requires only a slight modification of the weapon of the type which has no effect on the normal operation of the weapon without the barrel extension and which utilizes a mounting arrangement for the barrel extension which may be fully protected during normal use and with no effect on the operation of the weapon.

A still further object of the invention is to provide a new and novel nightstick serving both as a nightstick and as a storage space for the barrel extension in a concealed manner.

Still another object of the invention is to provide a new and novel nightstick for storing a barrel extension for a weapon.

A still further object of the invention is to provide a wrench which permits a barrel extension to be easily mounted on the barrel of a weapon and to facilitate removal of the barrel extension in a heated condition.

Still another object of the invention is to provide a new and novel detachable handle for a barrel extension which facilitates the operation of the weapon on which the barrel extension is mounted.

The objects stated above and other related objects will become more apparent in the light of the following specification taken in connection with the accompanying drawings, in which:

BRIEF DESCRIPTION OF THE DRAWINGS

FIG. 1 is a perspective view of a weapon modified to accommodate the barrel extension of the invention;

FIG. 2 is a side view partially in section of the muzzle of the weapon of FIG. 1;

FIG. 5 is a side view of various barrel extensions constructed in accordance with the invention;

FIG. 8 is a perspective view of part of a kit containing the various components of the barrel extension of the invention.

DESCRIPTION OF THE PREFERRED EMBODIMENT

Figure 3:
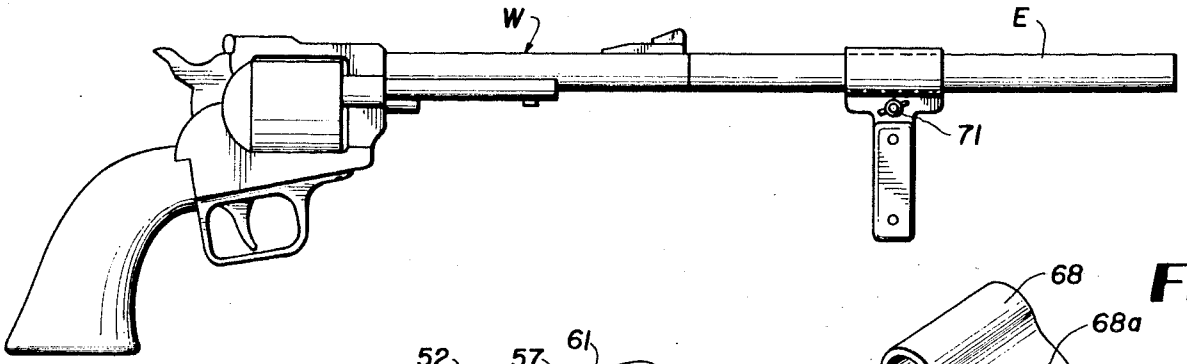
FIG. 3 is a side view of the weapon of FIG. 1 together with the barrel extension of the invention in a mounted position.

Referring now to the drawings, and to FIG. 1 in particular, there is shown a weapon and in particular a pistol or revolver W having a barrel 11. The revolver W is generally of conventional construction, but includes a muzzle 12 which has been modified in accordance with the invention.

As shown best in FIG. 2, the barrel 11 includes a central bore 13 provided with rifling 14 in the conventional manner and the forward end portion of the barrel 11 or muzzle 12 is provided with an internally threaded surface 16 within the surface of the barrel wall defining the bore 13. This internally tapped end portion of the barrel 11 is arranged to receive an externally threaded portion 17 of a muzzle thread protector 18 having a smooth central bore 19 and a head portion 21, the outer diameter of which corresponds to the outer diameter of the barrel 11. In addition, the inner diameter of the muzzle thread protector 18 has a central bore 19 which corresponds to the inner diameter of the barrel bore 13 so that when the threaded portion 17 of the muzzle thread protector 18 is threadedly inserted within the threaded portion 16 of the barrel 11, a shoulder **22*a* formed by a portion of reduced diameter 22 of the head portion 21 engages the end of the barrel 11 in abutting engagement with the bore 19 of the muzzle thread protector 18 and the bore 13 of the barrel 11 in coaxial alignment as shown in FIG. 1**.

A pair of barrel extensions constructed in accordance with the invention are shown in FIG. 5 and are designated by the letters E and E'. The extensions E and E' are of different lengths and each are made from 4140 molybdenum steel and thus will provide for perfect thermal expansion of the bullet which is made of lead and brass.

Each of the barrel extensions such as barrel extension E include a tubular member 24 having a side wall 26 defining a smooth central bore 27 which is provided with an externally threaded portion 28 at one end forming parts of a portion of reduced diameter 29. The externally threaded end portion 28 is arranged to be threadedly engaged with the internally threaded surface 16 to mount the barrel extension E on the revolver W in the manner as shown in FIG. 3. In the mounted position, with the threaded portions 28 and 16 in threaded engagement, a shoulder 29*a* formed by the portion of reduced diameter 29 abutts the forward end of the barrel 11 in the manner as shown in FIG. 3 with the barrel extension bore 27 in coaxial alignment with the bore 13 of the barrel 11.

Figure 4:
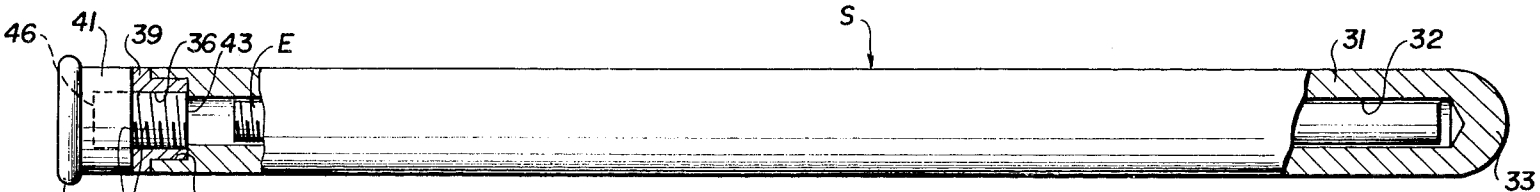
FIG. 4 is a side view partially in section of a nightstick constructed in accordance with the invention.

In order to provide a suitable and convenient storage for the barrel extension E (or E') another feature of the invention is shown in FIG. 4 which illustrates a nightstick constructed in accordance with the invention and designated generally by the letter S. The nightstick S comprises a cylindrical member 31 preferably of wood, provided with a longitudinally extending central bore 32, closed at one end 33. The other end of the cylindrical member 31 is open at 34 and the portion of the cylindrical member 31 adjacent the open end 34 is provided with an internally threaded surface 36. The central bore 32 of the cylindrical member 31 forming the nightstick S has an inner diameter sufficient to loosely accommodate the barrel extension E as shown in FIG. 4 with the extension E extending longitudinally within the cavity provided by the bore 32. In the preferred embodiment, the end portion of the night stick adjacent the open end 34 is notched circumferentially and internally at 38 to accommodate a ferrule 39, the inner bore of which is provided with the threaded surface 36. The ferrule 39 may be formed of any suitable material such as plastic or the like.

The nightstick S is provided with a closure member 41 for closing the open end 34 of the nightstick S so as to retain the extension E disposed within the bore 32. More specifically, the closure member 41 includes a portion of enlarged diameter 42 to facilitate the gripping of the night stick S in the conventional manner and a portion of reduced diameter 43 provided with external threads 44. Preferably, the closure member 41 is formed of a suitable material such as wood, plastic or the like and the portion of reduced diameter 43 is formed of a metal rod suitably secured within a recess 46 in the closure member 41. In the assembled position, the threaded surface 44 is threadedly engaged with the threaded surface 36 in the ferrule 39 of the cylindrical member 31 with the barrel extension E disposed within the bore 32 thereby retaining the barrel extension in a stored position.

The barrel extension E (E') and various tools associated with the barrel extension may be supplied in a kit form as shown in FIG. 8 and designated generally by the letter K. In the form shown in FIG. 8, a substantially flat carrier 51 may be utilized for storage of the parts of the kit, the upper surface of the flat carrier 51 being provided with suitably shaped recesses R shaped to accommodate the various parts. It should be understood, that the flat carrier 51 may be provided with a cover, if desired.

Figure 7:
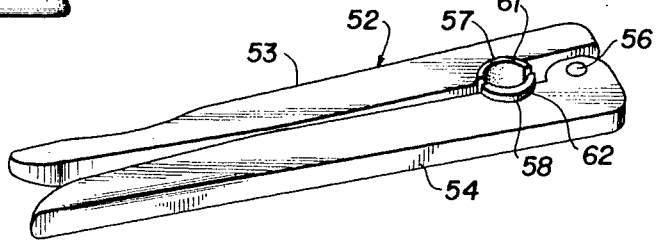
FIG. 7 is a perspective view of a barrel wrench utilized with the barrel extension of the invention.

The various tools associated with the barrel extension E (E') include a barrel wrench 52 shaped similar to a "nutcracker" and having a pair of arms 53, 54 pivotally connected together by a pivot pin 56 at one end so that the arms 53, 54 may be moved between an open position and the closed portion of FIG. 7. The arms 53, 54 are provided with arcuate recesses 57, 58 respectively adjacent the pin 56 which accommodate arcuate members 61, 62 of heat insulating material suitably secured therein. Thus, in the use of the wrench 52, by opening the arms 53, 54 and subsequently moving the arms 53, 54 together with the barrel extension E clamped therein, the barrel extension E may be tightly screwed into the muzzle 12 of the weapon W for assembly. Similarly, the barrel extension E may be removed from the weapon W by similarly clamping the barrel extension E with the wrench 52 permitting the barrel to be easily unscrewed. This is particularly advantageous when the barrel is hot after use to prevent burning of the hands.

Figure 6:
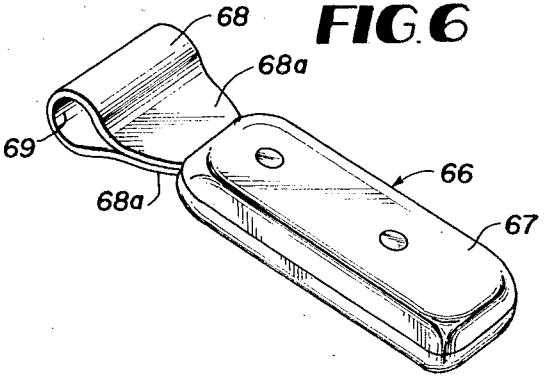
FIG. 6 is a perspective view of a portable handle utilized with the barrel extension of the invention.

Another tool included in the kit K is a portable handle 66 as shown in FIG. 6 which includes a hand grip 67 on one end of which is mounted a loop member 68 of metal or the like. One end portion of the loop member 68 is secured permanently to the grip 67, the other end portion being movable into a spaced relationship with the end portion 68*a* to permit the barrel extension E to be inserted within a circular opening 69 formed by the loop member 68. The end portion of the loop 68 may then be secured into the clamped position of FIG. 3 by means such as a wing nut 71 inserted through a suitably provided aperture in the loop portion into a suitably threaded opening in the loop portion 68*a*.

I claim:

1. A barrel extension for a bullet firing weapon having a barrel and an internally threaded forward end portion comprising a tubular member of metal having a longitudinally extending central bore, said central bore being defined by a smooth inner uniform wall having an inner diameter corresponding to the inner diameter of the barrel of said weapon, said barrel extension having an outer uniform diameter corresponding to the outer diameter of said weapon barrel, said barrel extension having an externally threaded end portion arranged for threaded engagement with said weapon barrel internally threaded end portion with the adjacent ends of said weapon barrel and barrel extension in abutting engagement;

a wrench for clamping engagement with said barrel extension during assembly and disassembly of said barrel extension on said weapon, said wrench comprisng a pair of clamping arms pivotally mounted together at one end for movement between an opened release position and a closed clamping position, an annular recess in each of said clamping arms adjacent one end, said annular recesses opening inwardly toward each other for clamping engagement with a barrel extension positioned therein in the closed position of said clamping arms.

2. A barrel extension in accordance with claim 1 including an arcuate member of insulating material in each of said recesses.

3. A barrel extension in accordance with claim 1 including a portable handle for said tubular member, said portable handle including a hand grip, a loop member having first and second end portions mounted on one end of said hand grip, said first end portion being secured to said hand grip, said second end portion being arranged for flexing movement in spaced relationship with said first end portion and into a clamping position adjacent said first end portion, means for securing said second end portion in a clamped relationship with said first end portion, said loop member having a bight portion defining a circular opening for accommodating said barrel extension in clamping engagement therewith in the clamped position of said loop member end portions.

4. A barrel extension in accordance with claim 3 wherein said barrel extension, said wrench, said portable handle and a muzzle thread protector are provided in an assembled relationship in the form of a kit and means for retaining said barrel extension, wrench, muzzle thread protector and portable handle in said assembled relationship in the form of said kit.

5. A barrel extension in accordance with claim 3 including a muzzle thread protector having a smooth central bore and an outer diameter corresponding to the outer diameter of said weapon barrel, said muzzle thread protector having an inner diameter corresponding to the inner diameter of the barrel of said weapon, said muzzle thread protector having an externally threaded end portion for threaded engagement with said internally threaded end portion thereby providing protection for the internal threads on said barrel end portion.

* * * * *